US005182828A

United States Patent [19]

Alivizatos

[11] Patent Number: 5,182,828

[45] Date of Patent: Feb. 2, 1993

[54] ROLL PREVENTING STRUCTURES

[75] Inventor: Margaret A. Alivizatos, Dallas, Tex.

[73] Assignee: Maurice Adam, Dallas, Tex.

[21] Appl. No.: 665,341

[22] Filed: Mar. 6, 1991

[51] Int. Cl.[5] ..... A47G 9/00

[52] U.S. Cl. ..... 5/631; 5/911; 5/930; 5/632

[58] Field of Search ..... 5/431, 432, 436, 450, 5/448, 911, 925, 930, 631, 632, 648

[56] References Cited

U.S. PATENT DOCUMENTS

| | | | |
|---|---|---|---|
| 2,314,080 | 3/1943 | Dine et al. | 5/431 |
| 2,562,725 | 7/1951 | Leto et al. | 5/431 |
| 2,765,480 | 10/1956 | Mueller | 5/436 |
| 2,952,856 | 9/1960 | Ruff | 5/437 |
| 3,811,140 | 5/1974 | Burpo | 5/431 |
| 3,924,282 | 12/1975 | Bond | 5/431 |
| 4,055,866 | 11/1977 | Evans | 5/911 |
| 4,171,549 | 10/1977 | Morrell et al. | 5/911 |
| 4,197,603 | 4/1980 | Greenhawk, Sr. | 5/431 |
| 4,227,270 | 10/1980 | Rivera | 5/436 |
| 4,397,052 | 8/1983 | Lund, III | 5/431 |
| 4,506,396 | 3/1985 | Ritchie, Jr. et al. | 5/431 |
| 4,606,087 | 8/1986 | Alivizatos | 5/424 |
| 4,607,403 | 8/1986 | Alivizatos | 5/911 |
| 4,667,356 | 5/1987 | Holmquist | 5/911 |
| 4,693,691 | 9/1987 | DeYoe | 5/911 |
| 4,733,836 | 3/1988 | Barnes | 5/431 |

*Primary Examiner*—Eric K. Nicholson

*Attorney, Agent, or Firm*—Hubbard, Thurman, Tucker & Harris

[57] ABSTRACT

A machine washable wedge shaped support structure is formed from a fabric envelope loosely filled with lightweight, preferably polystyrene, beads which shape it. The fabric may have a non-skid surface to resist sliding in use. The wedge conforms to a patient's or infant's body. When compressed, the fabric envelope and beads lock into a roll-preventing support structure. One alternate version has a stabilizing panel extending from the pointed end of the wedge on which a patient lies. Another version has a connecting panel between two opposing triangular shaped wedges. It provides roll preventing support for a pregnant woman and doubles as an anti-roll pad for infants.

20 Claims, 2 Drawing Sheets

ROLL PREVENTING STRUCTURES

BACKGROUND OF THE INVENTION

1. Field of the Invention

One or more wedge shaped roll preventing structures are disclosed which aid in supporting the body of an adult or infant lying on their side on a supporting surface.

2. Background of the Prior Art

There has been a need for a reusable aid for supporting an adult patient or an infant on their side, in a lying down position, to prevent the patient from rolling onto their back or stomach. Oftentimes, patients or infants are unable to fully control their bodies, especially during sleep. It may be desirable to keep an adult patient on one side to avoid pressure on an injured arm or side, or simply as an alternate position to reduce the incidence of decubitii. In the case of babies, it is known that if a baby lies on its back, the stomach does not empty completely. There is an increased risk of regurgitation and aspiration which is reduced if the infant is kept on its side. A side lying position is an alternative to a stomach position for a neo-nate. The risk of aspirating stomach contents is reduced.

Ordinary pillows are commonly used in an effort to provide support in order to keep a patient from rolling. It is often necessary to have a plurality of pillows, and even then they are not very effective because pillows are generally soft, compressible and lacking in support. Even when they are bunched against the patient, they are easily moved and have a tendency to return to their original unbunched configuration.

Cloth diapers or towels may be rolled or folded and placed against an infant, but they still tend to be compressible and roll or move away.

It would be convenient to have a machine washable reusable roll preventing structure which is compact and provides improved support to a patient or an infant lying on its side.

SUMMARY OF THE INVENTION

A machine washable wedge shaped support structure in several variations is usable as a roll-preventing patient support. A soft flexible fabric envelope is provided in the shape of an elongated wedge structure which is filled with a multiplicity of discreet lightweight plastic filler material, preferably polystyrene beads, contained within the fabric envelope which forms the wedge shaped structure. The envelope is preferably made from a soft, comfortable fabric. Because the filler does not absorb moisture, the structure is conveniently machine washable and quickly dried.

There is a structural interaction between the fabric envelope and the plastic beads contained within the envelope which help form the basic wedge shape. The envelope is not tightly filled with the filler material so that it can be molded to fit the contour of the body. The beads can move around within the envelope. Yet when the wedge-shaped roll preventing structure is subject to compression, the beads and the fabric tend to lock together in the previously adjusted shape, to provide a firm support.

A basic wedge-shaped support structure has a fabric base panel and a pair of fabric support panels extending from the base panel and converging towards a pointed end of the wedge opposite the full length of the base panel at a longitudinal front edge. Opposite triangular shaped fabric side panels form the transverse ends of the wedge in cooperation with the upper and lower support panels, the ends of the base panel and the ends of the front edge. The point of the triangular shaped side panels join the converging upper and lower support panels at the transverse sides of the front edge of the wedge. The places where the various panels come together can be folds in a piece of fabric or seams, but in any event the edges of the panels are coextensive to form a fillable wedge shaped enclosure which is filled with the lightweight plastic filler material.

In another embodiment, there is at least one fabric extension panel extending away from the front edge portion of the wedge shaped fabric envelope. The extension panel or panels extend a substantial distance away from the base panel to form a stabilizing pad for placing under a patient to help hold the wedge shaped support in place. This is especially useful if it is desired to use a sheet or pillowcase type fabric material for the fabric envelope, because the patient's weight on the stabilizing pad tends to prevent an movement of the stabilizing pad or the attached roll preventing structure.

In a further embodiment, there is a combination machine washable roll preventing support structure for a pregnant woman which doubles as an anti-roll pad for infants. It has oppositely oriented first and second fillable wedge shaped fabric support structures defined by a fabric envelope having a triangular cross section and upper and lower support panels converging to meet at a pointed edge. The oppositely oriented fillable wedges are filled with a multiplicity of lightweight plastic beads contained within and shaping each of them. The opposite facing wedges are connected to a flat connecting panel connecting the pointed front edges of the oppositely arranged first and second wedge shaped support structures. The wedge shaped support structures and the connecting panel are a suitable length for cradling against the front and back of a pregnant woman lying on her side and in partial support thereof. The connecting panel is designated to lie under the woman's body. This is an extremely stable arrangement which can also provide some support for the abdominal area. Because of its shape and arrangement, it is ideally suited for use as an anti-roll pad after the baby is delivered. The baby is placed on the connecting panel and the oppositely arranged wedges keep the baby from rolling off. If soiled, it is completely machine washable and quick drying.

DETAILED DESCRIPTION

Figure 5:
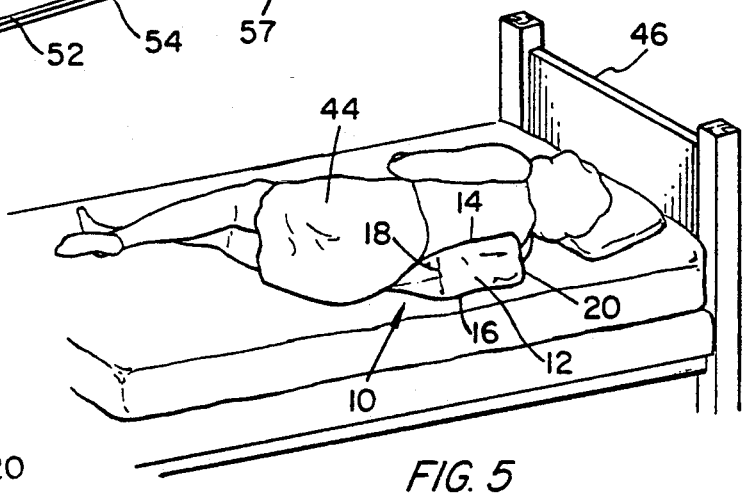
FIG. 5 is a perspective view of a patient, with a roll-preventing structure such as the structure of FIG. 4 or 6 in supporting contact against her back.
Figure 6:
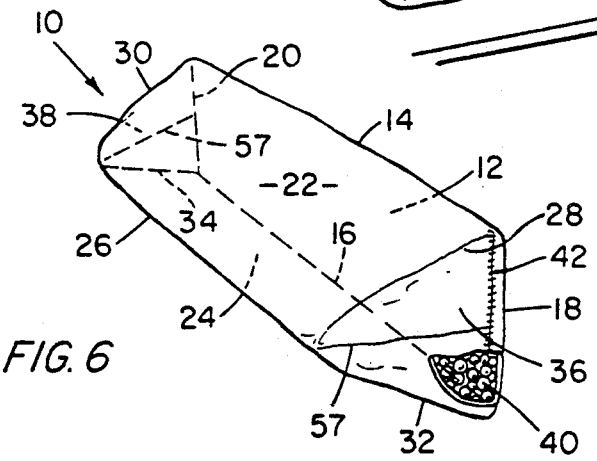
FIG. 6 is a perspective view of a basic roll-preventing structure in the shape of a wedge.
Figure 7:
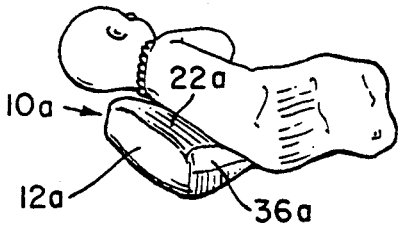
FIG. 7 is a perspective view of a miniature basic roll-preventing structure of the type shown in FIG. 6 in supporting contact with an infant's back.

In the description that follows, like parts will be identified by the same reference numerals. In FIGS. 5–7 is a basic roll-preventing structure 10 also denominated 10*a* in a reduced scale version for a baby. In FIG. 6 is a machine washable wedge-shaped support structure for roll prevention in an adult. The structure may be formed in an adult size as in FIG. 5 or in a miniaturized version as illustrated in FIG. 7.

Structure 10 has a substantially flat base panel 12 defined by spaced apart substantially parallel longitudinal edge portions 14 and 16, and transverse edge portions 18 and 20. Transverse edge portions 18, 20 extend between the ends of longitudinal edge portions 14, 16. A pair of fabric support panels 22 and 24 have longitudinal edges 14 and 16 coextensive with the longitudinal edges 14, 16 of the base panel. Support panels 22, 24 are angled to converge toward each other to meet at a longitudinal front edge 26 spaced away from the longitudinal edge portions 14 and 16. Support panel 22 has transverse edge portions 28 and 30 and support panel 24 has transverse edge portions 32 and 34. The transverse edge portions extend between ends of one of the longitudinal edge portions 14, 16 and the front edge 26.

Opposite triangular shaped fabric side panels 36, 38 are at opposite ends of the other panels. Triangular shaped side panel 36 has a base edge coextensive with transverse edge 18 of the base panel and converging side edges coextensive with the transverse edge portions 28 and 32 of the pair of support panels extending between the base panel and the front longitudinal edge portion. Triangular shaped fabric side panel 38 has a base edge coextensive with the transverse edge 20 of the base panel and converging side edges coextensive with the transverse edge portions 30 and 34 of the pair of support panels extending between the base panel and the front longitudinal edge portion. The term coextensive means that the edges overly each other on a line as in a fold or a seam. The base panel 12, support panels 22, 24 and side panels 36, 38 comprise a fillable wedge-shaped fabric envelope and enclosure. The enclosure is filled with a multiplicity of discreet lightweight plastic filler material contained within said fabric panels, substantially filling the enclosure and forming the fabric panels into a machine washable wedge shape. A seam 42 may be closed after filling. Seams may also be made by heat sealing a heat sealable fabric.

In FIG. 5, a patient 44 is seen lying on her side on the surface of a bed 46 with the basic roll preventing structure 10 tucked against her back. In FIG. 7, a miniaturized version of the basic roll preventing structure 10*a* is employed to keep a baby from rolling back. It has the same wedge shape, but is smaller. The corresponding panels and edges are identified with "a's".

Figure 4:
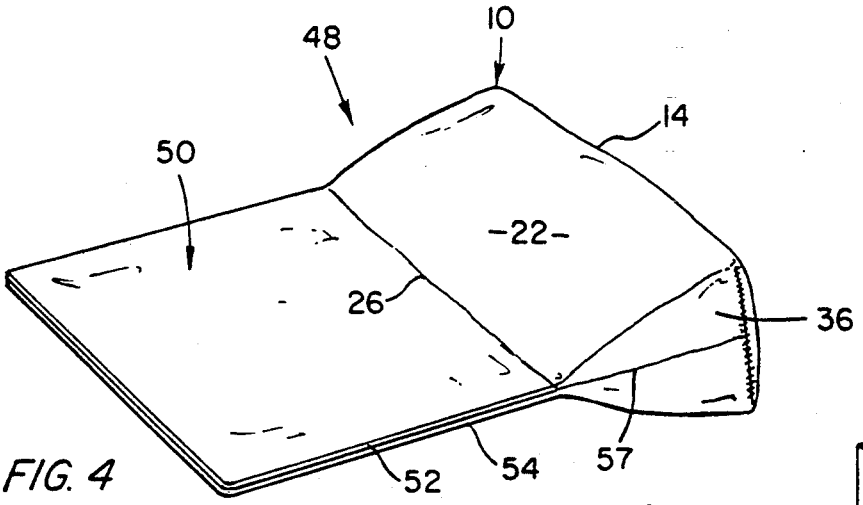
FIG. 4 is a perspective view of a wedge shaped roll-preventing structure having fabric extension panels extending from the longitudinal front edge portion.

In FIG. 4 is seen an alternate roll preventing structure 48 which includes a basic roll preventing structure 10 with fabric extension panels 52, 54 connected to the longitudinal front edge portion 26 of the basic structure 10. The extension panels 52, 54 extend away from the front edge portion 26 a substantial distance to form a stabilizing pad 50 for placing under a patient to help hold the wedge-shaped support in place. The stabilizing pad 50 is seen as a dual layer having an upper layer 52 and a lower layer 54 overlying each other in abutting relationship in the form of a substantially rectangular shape.

It can be seen that when the patient is lying upon a fabric extension panel of stabilizing pad 50, with the basic wedge-shaped structure 10 in contact with a portion of the back and side, the patient's weight holds the structure 10 in place even if the fabric envelope of the structure 10 is made from ordinary bedding materials. It may be seen that the upper fabric extension panel 52 may be continued through upper support panel 22, and around panels 12 and 24 of basic wedge 10 and continued beyond the underside of front edge 26 as extension panel 54. Alternately, only one extension panel 52 or 54 may be used to make a stabilizing pad. In either case, the structure 48 can be made with a single length of fabric. Even the triangular end panels 36, 38 can be unitary with a web of fabric by folding at the edges and joining them at a seam, such as seam 57.

Figure 1:
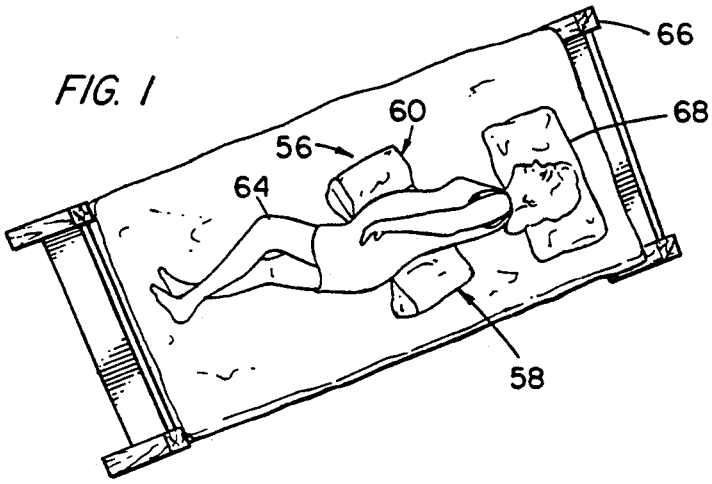
FIG. 1 shows a perspective view of the combination machine washable roll preventing structure and baby changing pad in support of a pregnant woman lying on her side.
Figure 2:
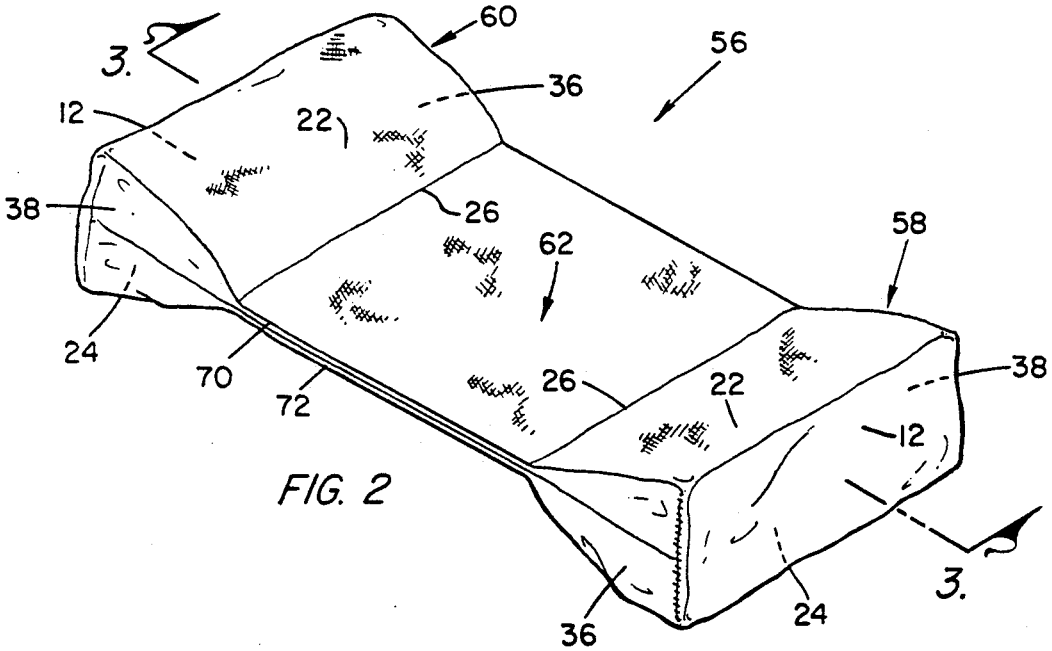
FIG. 2 is a perspective view of a combination structure.
Figure 3:
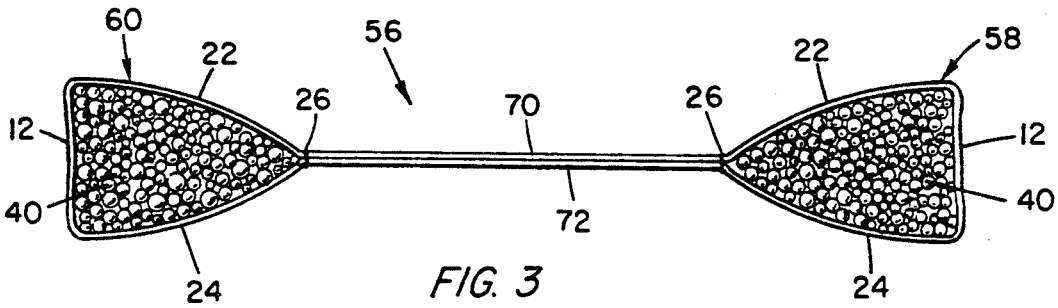
FIG. 3 is a cross-section of the combination structure of FIG. 2 along the lines 3—3.

FIGS. 1–3 represent a further alternative roll preventing structure designated generally by the reference numeral 56 which is a combination machine washable roll preventing support structure for a pregnant woman which doubles as a baby changing pad.

Roll preventing structure 56 has a first fillable wedge shaped fabric support structure 58 and an oppositely oriented spaced apart second fillable wedge shaped fabric support structure 60. The first and second fillable wedge shaped support structures 58, 60 are like the wedge shaped structure 10 in FIG. 6 except that they are joined by a flat connecting panel 62, connecting the pointed longitudinal front edges 26 of the wedges 58 and 60. The flat connecting panel 62 is of a length chosen to hold the first and second wedge shaped supports 58, 60 cradled against the front and back of a pregnant woman lying on her side and in partial support thereof.

FIG. 1 shows a pregnant woman 64 lying on her side on a bed 66 with her head on a pillow 68 and the roll preventing structure 56 under her side and abdominal area. She is lying on the flat connecting panel with the second fillable wedge 60 in partial support of the abdomen and the first fillable wedge 58 in partial support of the side and lower back.

In FIGS. 2 and 3, the opposed first and second fillable wedge shaped fabric support structures are seen to be defined by a fabric envelope having a triangular shaped cross section in FIG. 3. The fabric envelope of the fillable wedge structures 58, 60 has upper and lower support surfaces 24, 26, back panel 12 and triangular shaped oppositely oriented end panels 36, 38. These panels are folded or seamed and the upper and lower support panels 22, 24 converge toward each other at a longitudinal front edge 26 where they are seamed. Together these panels form a fillable enclosure which is filled with a multiplicity of lightweight plastic beads 40 contained within each of them and shaping each of the first and second fillable wedges. The flat connecting panel 62 extending between the longitudinal front edges 26 of wedges 58, 60 may be composed of an upper fabric layer 70 and a lower fabric layer 72, as a dual layer which may be seamed or otherwise joined as the flat connecting panel 62. It may be seen that the upper and lower layers 70, 72 of the connecting panel and the panels 22, 12, 24 of each of the opposing wedges may be folded and seamed from a single web of fabric. A connecting panel 62 made from a dual layer of upper and lower panels 70, 72 is preferred for a better hand and feel as well as strength, but could be made from a single layer 70 or 72.

In the best mode, the fabric envelope is preferably made from a fabric which is washable. The fabric has visible air and water permeable openings between the threads which are small enough to retain polyester beads or particles from crushed or partially formed beads. The fabric panels for the wedge shaped structure are formed from an open mesh synthetic fabric. The fabric may be heat sealable to form the structure and has a non-skid surface. The open mesh synthetic fabric and filler beads allow free flow of air and liquids. The polystyrene filler beads are insulating and assist in thermal regulation and in offering the patient or an infant a feeling of warmth and security in contact with the skin.

The floatable filler material is preferably spherical, resilient plastic beads formed from an expanded cellular plastic, expanded to a diameter in the range of about 0.062 inches to 0.18 inches and is substantially liquid impermeable and extremely lightweight. The fabric envelope is not tightly packed so that it is easy to form a partial depression which aids in holding the patient. The use of the polystyrene beads or spheres provides a nonpermeable filler material which will not retain moisture or harbor bacteria and it is particularly advantageous as compared with the use of shredded or open cell plastic materials. The completed unit is mildew resistant and fully washable and because it does not absorb water, it quickly dries in machine or air dry situations. The washable, lightweight material does not absorb odors and is completely buoyant and floats.

Although preferred embodiments of the present invention have been described here in detail, those skilled in the art will recognize the various substitutions and modifications which may be made to the specific structures and methods of fabrication without departing from the scope and spirit of the invention as recited in the appended claims.

I claim:

1. A freestanding machine washable wedge shaped support structure for use as a roll-preventing, patient support, comprising:

an open mesh fabric base panel defined by spaced apart substantially parallel longitudinal edge portions and transverse edge portions between the ends of said longitudinal edge portions;

a pair of open mesh non-skid fabric support panels having longitudinal edge portions coextensive with the longitudinal edges of the base panel, said panels converging toward each other to meet at a longitudinal front edge spaced away from said longitudinal edge portions, each of said support panels having transverse edge portions extending between ends of one of said longitudinal edge portions and said front edge;

opposite triangular shaped open mesh fabric side panels, each side panel having a base edge coextensive with one transverse edge of the base panel and converging side edges coextensive with the transverse edge portions of the pair of support panels extending between said base panel and said front longitudinal edge portion to form an envelope; and a multiplicity of discrete lightweight nonabsorbent plastic floatable foam beads contained within the envelope by said open mesh fabric to form a wedge, substantially filling said envelope to a degree that allows free movement of said beads within the envelope so that the wedge can be molded to fit the contour of the patient's body, yet having the characteristic that when the envelope and plastic beads are compressed by a patient's weight, they interact to lock together in the previously molded shape to provide a firm support which restricts movement of the patient and allows circulation of air and moisture to help keep the patient dry

2. The wedge shaped roll preventing patient support of claim 1 wherein the longitudinal front edge portion is substantially the same length as the longitudinal edge portion of the base panel.

3. The wedge shaped roll preventing patient support of claim 2 wherein the base panel, support panels and side panels are formed from a single length of fabric.

4. The wedge shaped roll preventing structure of claim 1 wherein the filler material comprises a multitude of lightweight polystyrene foam beads.

5. The wedge shaped roll preventing structure of claim 1 wherein the fabric panels are formed from an open mesh synthetic fabric.

6. The wedge shaped roll preventing structure of claim 1 wherein the fabric is heat sealed to form the structure.

7. The wedge shaped roll preventing structure of claim 4 wherein the fabric has a non-skid surface.

8. A machine washable roll preventing support structure for use as a roll preventing patient support comprising:

a fabric base panel defined by spaced apart substantially parallel longitudinal edge portions and transverse edge portions between the ends of said longitudinal edge portions;

a pair of fabric support panels having longitudinal edge portions coextensive with the longitudinal edges of the base panel, said support panels converging toward each other to meet at a longitudinal front edge portion spaced away from said base panel, each of said support panels having side edge portions extending between one of the ends of the longitudinal edge portions of the base panel and said front edge portion;

opposite fabric side panels, each side panel having edges coextensive with each of the side edges of the support panels and a transverse edge of the base panel, having a triangular shape and together with the support panels and base panel forming a fillable wedge shaped fabric enclosure;

a multiplicity of discrete lightweight nonabsorbent plastic floatable foam beads contained within the wedge shaped fabric enclosure to form a wedge, substantially filling said enclosure to a degree that allows free movement of said beads within the fabric enclosure so that the wedge can be molded to fit the contour of the patient's body, yet having the characteristic that when the fabric enclosure and plastic beads are compressed by a patient's weight, they interact to lock together in the previously molded shape to provide a firm support which restricts movement of the patient, and at least one fabric extension panel extending from said front edge portion a substantial distance away therefrom to form a stabilizing pad for placing under a patient to help hold the wedge shaped support in place.

9. The machine washable roll preventing support structure of claim 8 wherein at least the base panel, support panels and extension panel are formed from a single length of fabric.

10. The machine washable roll preventing support structure of claim 8 wherein the filler comprises a multitude of lightweight polystyrene foam beads.

11. The machine washable wedge shaped support structure of claim 7 wherein the extension panel is formed as a continuation of at least one of said fabric support panels.

12. The machine washable wedge shaped support structure of claim 11 wherein the fabric is heat sealable.

13. A combination machine washable roll preventing support structure for a pregnant woman which doubles as a baby changing pad, comprising:

a first fillable wedge shaped fabric support structure defined by a fabric envelope having a triangular cross section and upper and lower support panels converging to meet a pointed edge of the first fillable wedge;

an opposite second fillable wedge shaped fabric support structure defined by a fabric envelope having a triangular cross section and upper and lower support panels converging to meet at a pointed edge of the second fillable wedge;

a multiplicity of discrete lightweight nonabsorbent plastic floatable foam beads contained within the fabric envelope to form first and second wedges, substantially filling said envelopes to a degree that allows free movement of said beads within said fabric envelopes so that each wedge can be molded to fit the contour of the patient's body, yet having the characteristic that when the fabric envelope and plastic beads are compressed by a patient's weight, they interact to lock together in the previously molded shape to provide a first support which restricts movement of the patient, and a flat connecting panel connecting the pointed edges of the oppositely arranged first and second wedge shaped support structures of a length chosen to hold said first and second wedges cradled against the front and back of a pregnant woman lying on her side in partial support thereof and usable after delivery as a baby's changing pad to prevent a baby from rolling off a surface.

14. The combination of claim 13 wherein the fabric envelope is made of a quick drying fabric to hold the filler.

15. The combination of claim 13 wherein at least the support panels of the first and second wedge shaped structures and the connecting panel are made from a continuous piece of fabric.

16. The combination of claim 14 wherein at least the support panels of the first and second wedge shaped structures and the connecting panel are made from a continuous piece of fabric.

17. The combination of claim 13 wherein the filler material comprises a multitude of lightweight nonabsorbent polystyrene foam beads.

18. The combination of claim 18 wherein the beads have variation in size of about at least an order of magnitude for purposes of good close packing characteristics.

19. The combination of claim 13 wherein the flat connecting panel is a dual layer, each layer expressed as a continuation of one of the upper and lower support panels.

20. A freestanding machine washable wedge shaped support structure for use in positioning a patient on a support surface comprising:

an elongated wedge shaped envelope having a generally triangular cross-section, said envelope having a base panel for placing on a patient support surface and an opposite support panel for contact with a patient;

said wedge shaped envelope being an open mesh fabric having a non-skid surface on at least said base panel, for inhibiting slippage when in contact with a patient support surface, said fabric having visible air and water permeable openings;

a multiplicity of discrete lightweight nonabsorbent plastic foam beads contained within the envelope by said open mesh fabric to form a wedge, substantially filling said envelope to a degree that allows free movement of said beads within the envelope so that the wedge can be molded to fit the contour of the patient's body, yet having the characteristic that when the envelope and plastic beads are compressed by a patient's weight, they interact to lock together in the previously molded shape to provide a firm support which restricts movement of the patient; and the combination of the open mesh fabric and discrete lightweight nonabsorbent plastic beads being able to provide free flow of moisture and air through the structure to facilitate quick drying.

* * * * *

UNITED STATES PATENT AND TRADEMARK OFFICE

CERTIFICATE OF CORRECTION

PATENT NO. : 5,182,828
DATED : February 2, 1993
INVENTOR(S) : Alivizatos

It is certified that error appears in the above-identified patent and that said Letters Patent is hereby corrected as shown below:

In column 2, line 21, delete "an" and add --any--.

In column 7, line 35, delete "first" and add --firm--.

Signed and Sealed this

Sixteenth Day of November, 1993

Bruce Lehman

*Attest:*

BRUCE LEHMAN

*Attesting Officer*

*Commissioner of Patents and Trademarks*